US006626594B1

(12) United States Patent
Lallemant

(10) Patent No.: US 6,626,594 B1
(45) Date of Patent: Sep. 30, 2003

(54) PRINTING MACHINE WITH A LATCH FOR UNLOCKING THE COVER

(75) Inventor: Jean-François Lallemant, Le Mesnil-le-Roi (FR)

(73) Assignee: Sagem S.A., Paris (FR)

( * ) Notice: Subject to any disclaimer, the term of this patent is extended or adjusted under 35 U.S.C. 154(b) by 0 days.

(21) Appl. No.: 10/207,939

(22) Filed: Jul. 29, 2002

(51) Int. Cl.[7] ..... B41J 29/13

(52) U.S. Cl. ..... 400/589; 400/602; 400/611; 400/663

(58) Field of Search ..... 400/578, 589, 400/602, 611, 634, 663, 586; 101/66

(56) References Cited

U.S. PATENT DOCUMENTS

| | | | | | |
|---|---|---|---|---|---|
| 4,712,114 | A | * | 12/1987 | Kikuchi | 347/218 |
| 4,910,602 | A | * | 3/1990 | Sakuragi | 358/296 |
| 5,137,385 | A | | 8/1992 | Kamimura et al. | |
| 5,537,225 | A | * | 7/1996 | Morikawa et al. | 358/475 |
| 5,668,637 | A | | 9/1997 | Yamaguchi | |
| 5,936,655 | A | | 8/1999 | Biedermann | |
| 6,068,419 | A | * | 5/2000 | Shiozaki et al. | 400/582 |
| 6,125,251 | A | * | 9/2000 | Shiraishi et al. | 399/124 |
| 6,155,730 | A | * | 12/2000 | Nakayama et al. | 400/613 |
| 6,155,731 | A | * | 12/2000 | Bertalan et al. | 400/621 |
| 6,345,782 | B1 | * | 2/2002 | Nakayama et al. | 242/564.4 |
| 6,393,244 | B1 | * | 5/2002 | Nakayasu et al. | 399/301 |
| 6,491,459 | B2 | * | 12/2002 | Hosomi | 400/613 |

FOREIGN PATENT DOCUMENTS

| | | |
|---|---|---|
| FR | 2755641 | 11/1996 |
| JP | 09246745 | 9/1997 |
| JP | 10119395 | 5/1998 |
| JP | 2001080162 | 3/2001 |
| JP | 2001253143 | 9/2001 |

* cited by examiner

*Primary Examiner*—Stephen R. Funk
*Assistant Examiner*—Dave A. Ghatt
(74) *Attorney, Agent, or Firm*—Eugene C. Rzucidlo

(57) ABSTRACT

The invention concerns a machine (1) for printing a substrate (5) taken from a supply (50), including a frame (2), a cover (3) movable relative to the frame, said frame (2) receiving the supply, and means (4) for printing the substrate (5) including in particular a print roller (6) and a print head, a machine, characterized in that it also includes a latch (9) articulated relative to the frame (2) allowing the cover to be unlocked relative to the frame.

9 Claims, 6 Drawing Sheets

PRINTING MACHINE WITH A LATCH FOR UNLOCKING THE COVER

The technical field of this invention is that of machines for printing a substrate, which are able to issue a control ticket after cutting, such as game ticket dispensing machines for example.

Printing machines comprise print means including a support roller integral with a cover and a print head integral with the frame. To disengage this support roller and change the roll-shaped substrate or to access the inside of the machine, it is necessary to disengage the cover from the machine frame. For personnel using this machine, this operation is not easy.

The purpose of this invention is to provide a printing machine equipped with means allowing the print substrate to be changed easily.

The object of this invention is therefore, first of all, a machine for printing a substrate taken from a supply, including a frame, a cover which is movable relative to the frame, said frame receiving the supply, and substrate print means including in particular a print roller and a print head, a machine characterized in that it also includes a latch articulated relative to the frame for unlocking the cover relative to the frame.

According to one characteristic of the invention, the latch is placed in the vicinity of the printed substrate output trajectory.

According to another characteristic of the invention, the latch is an approximately L-shaped handle with the lower branch placed so as to engage with the cover and the upper branch placed so as to be activated by an operator.

According to another characteristics of the invention, the lower latch branch is fitted with hooks to engage with the cover.

According to yet another characteristic of the invention, the machine comprises a printed substrate ejection roller integral with the cover.

The ejection roller is to advantage placed so as to push against the latch.

According to another embodiment of the invention, the latch delimits with the cover a printed substrate reception housing.

The machine may comprise printed substrate jam detection means integral with the latch.

The machine may also comprise printed substrate read means integral with the latch.

A first advantage of the machine according to the invention lies in the ease of access to the print substrate and to its roll-shaped supply.

Another advantage lies in the fact that the latch is easily integrated into the machine and provides extended functionalities.

Other characteristics, details and advantages of this invention will become more clearly apparent from the description provided below for information, with reference to the drawings, wherein.

Figure 1:
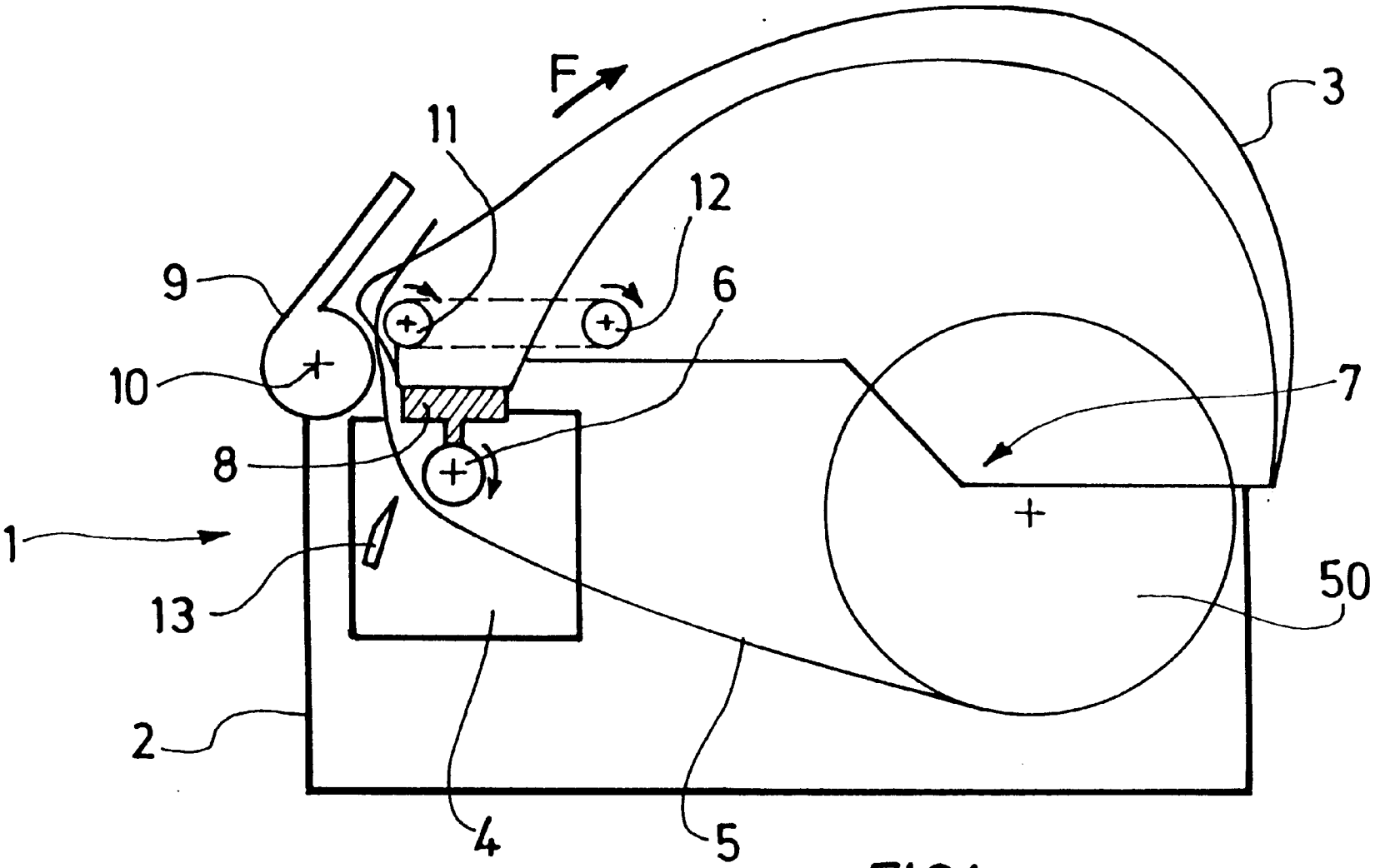
FIG. 1 is a cross-sectional view showing the machine according to the invention diagrammatically.

As explained above, the printing machine 1 according to of the invention is constituted by a frame 2 and a movable cover 3. To facilitate manufacture, the frame may separate into two parts. The frame 2 houses the print means 4, the structure of which has no need to be explained, a print substrate 5 presenting itself in spool form from the supply roll 50. The print means conventionally incorporate a support or print roller 6, which must be separated from a print head when access is required inside the frame. The cover 3 protects the print substrate 5 and is articulated relative to the frame 2 around the axis 7. Opening it along the arrow F (FIG. 1) makes it possible to access the substrate 5, and to release it as will be explained below. The print substrate 5 is therefore unrolled and inserted into the print means 4 along a standard trajectory and is held in place by means of the roller 6. In FIG. 1, it may be seen that the support roller 6 is integral with an intermediate part 8, itself attached to the cover 3.

According to the invention, a latch 9 is provided mounted to rotate relative to the frame 2 around an axis 10, and engaging with the cover 3 so as to disengage the roller 6 from the print head. This latch 9 is preferentially placed in the vicinity of the output trajectory of the printed substrate 5 as shown in FIG. 1. An ejection roller 11 is mounted on the cover 3 and is rotated for example by means of a motor 12. The ejection roller 11 is placed in the vicinity of the latch 9 so as to guide the printed substrate as will be explained below.

The machine 1 according to the invention may include means 13 for cutting the printed substrate, located downstream from the print means 4.

Figure 2:
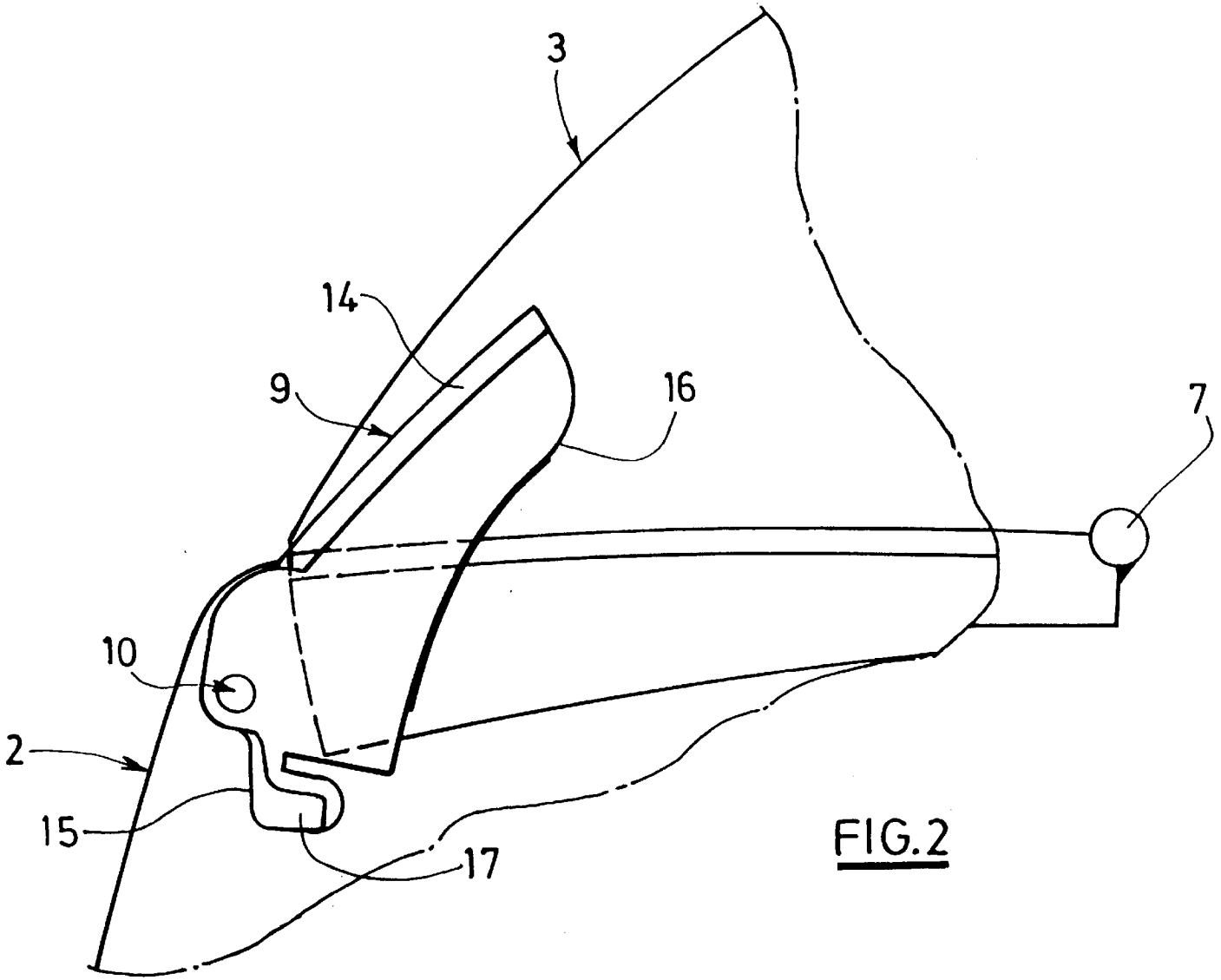
FIG. 2 is a cross-sectional view showing the latch in the initial, cover closed, position.

In FIG. 2 the latch 9 is shown in cross-section. This latch may for example be L-shaped with a wall on either side to create a receptacle. In FIG. 2, it can be seen that the latch comprises an upper branch 14, a lower branch 15 and one of the lateral walls 16. The lower branch 15 is fitted with lateral hooks 17, only one of which can be seen in the figure. In the rest position shown in this figure, it can be seen that the hooks 17 are free and do not interfere with the cover 3. The upper branch 14 is inserted in a cut on the anterior side of the cover 3.

Figure 3:
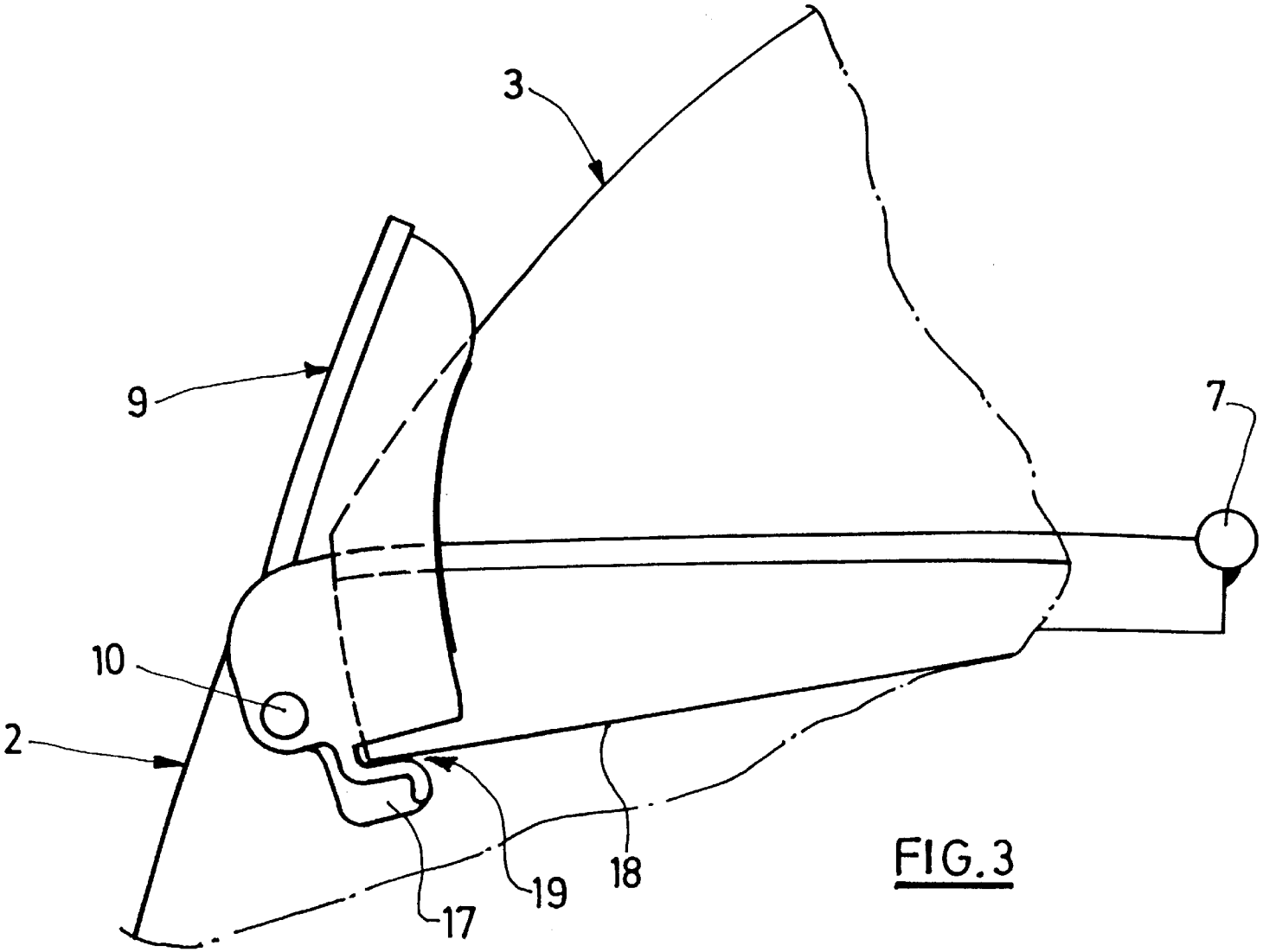
FIGS. 3 to 5 show various steps in opening the cover using the latch and FIG. 6 is a cross-sectional view showing the installation of the different components in the machine and in the latch.
Figure 4:
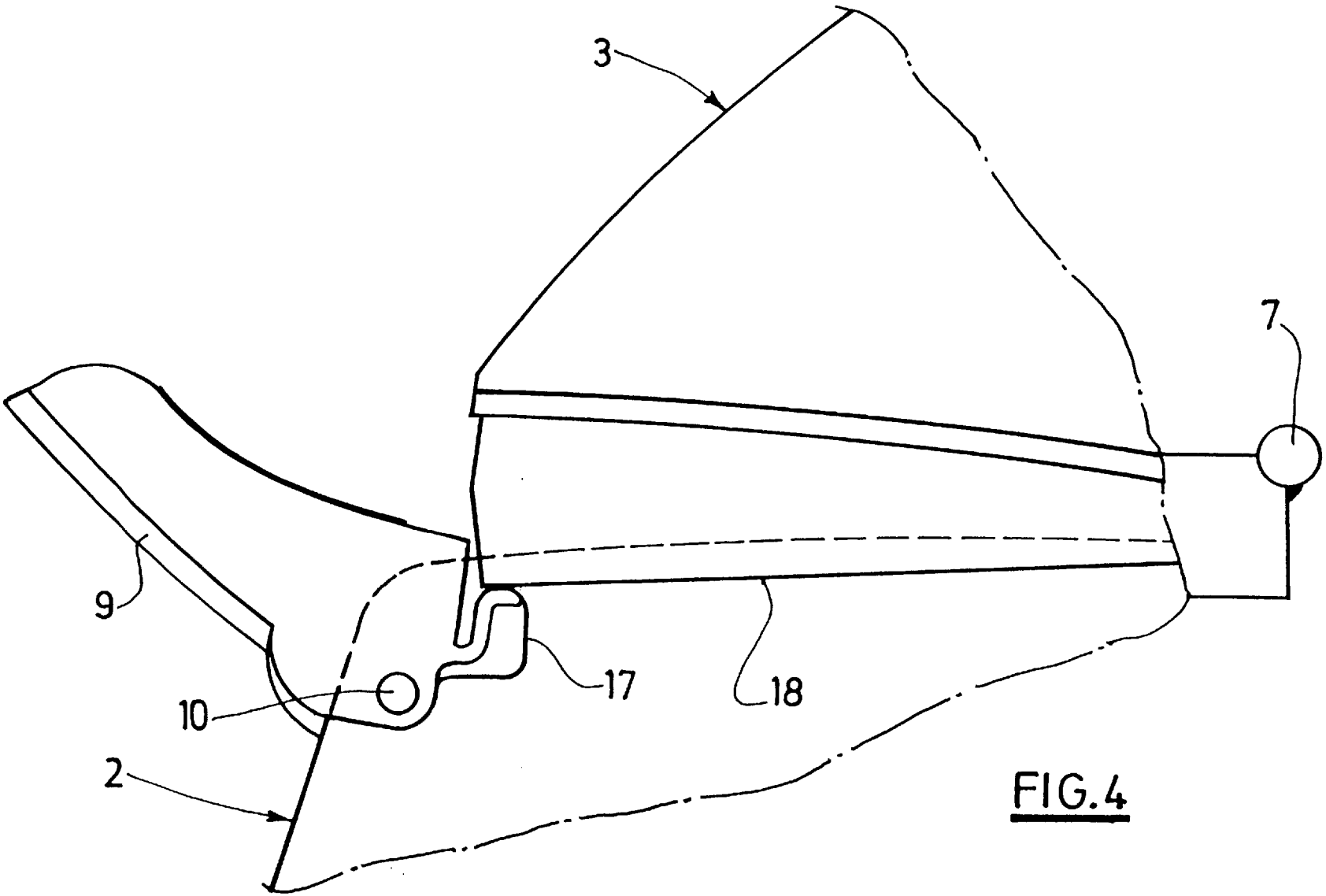
Figure 5:
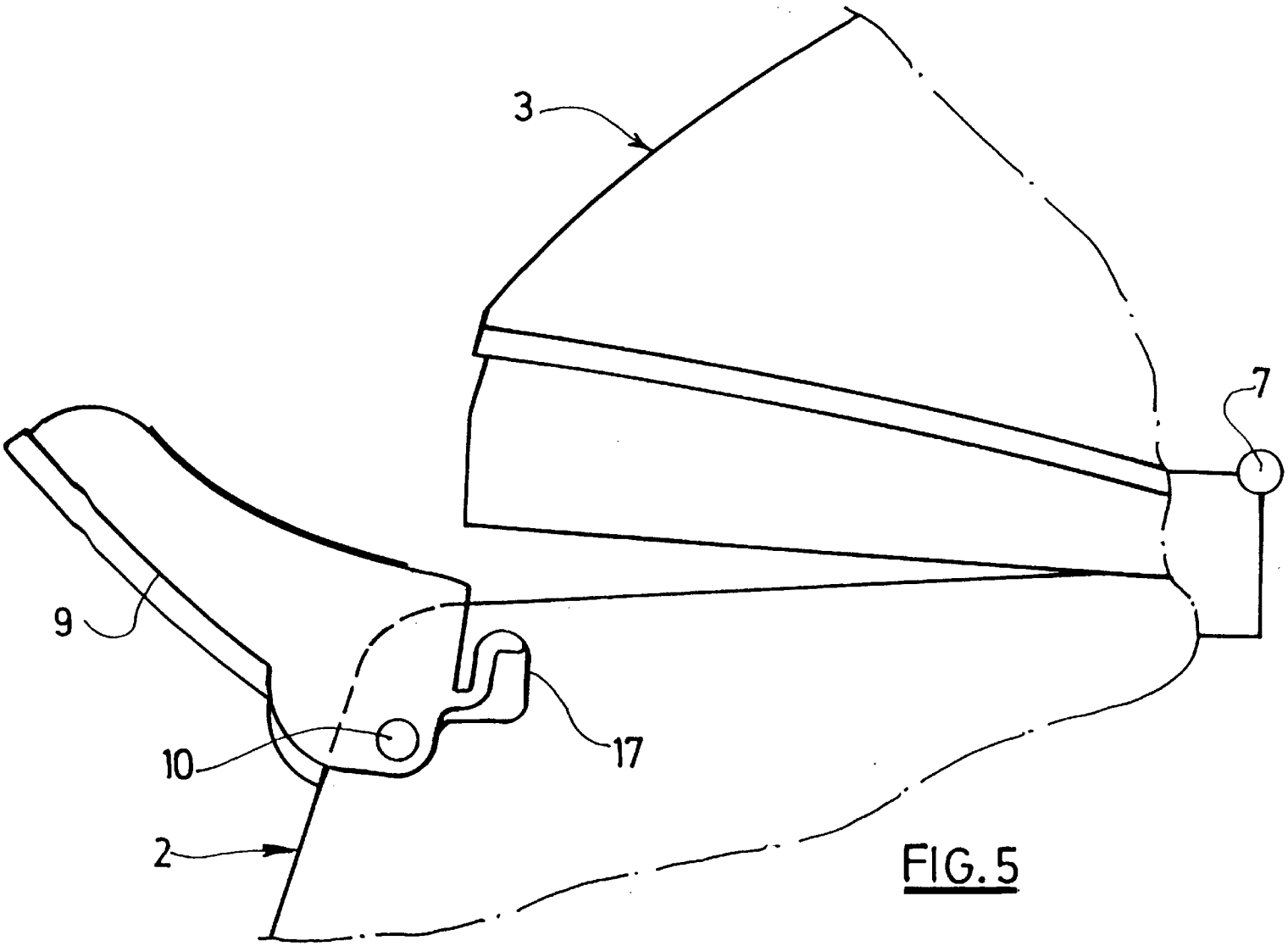

In FIG. 3 is shown the position of the latch 9 when it is required to separate the cover 3 from the frame 2. To do so, the latch 9, whose lateral spurs 17 come into contact with the base 18 at connection points 19, is activated by rotation around the axis 10. By continuing to rotate the latch 9, as shown in FIG. 4, the cover 3 is separated from the frame 2, the spurs 17 pushing against the base 18. Rotating the cover 3 around the axis 7 drives the intermediate part 8 and consequently the roller 6. After the cover 3 is opened, the latch 9 occupies a final position as shown in FIG. 5. In this final position, the latch 9 is immobilized against rotation by an interlocking linkage as long as the cover 3 is not closed. Closing the cover 3 allows the latch 9 to return by reverse kinematics to its rest position in FIG. 2.

Figure 6:
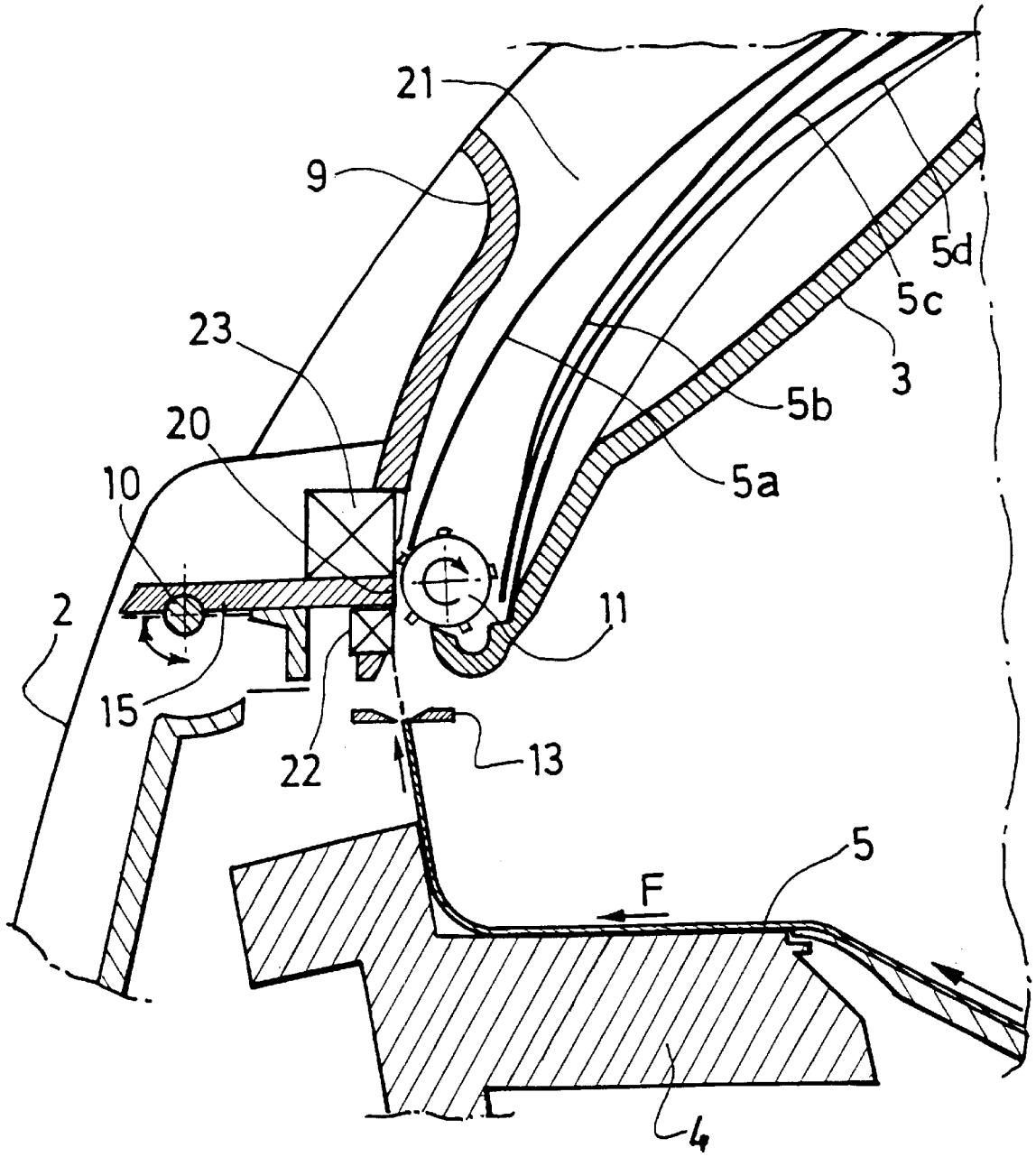

The cross-section according to FIG. 6 shows the embodiment detail showing the Integration of the latch 9 in the printing machine 1 and occupying the rest position in FIG. 2. In this figure, the references remain the same and it can be seen that the print substrate 5, after passing through the print means 4, may be cut by means of the cutting knife 13 and continues its trajectory being driven by the ejection roller 11. To this end, the roller 11 rests on the latch 9 in an area 20 constituting a counter-support surface for driving the substrate 5 after printing so as to completely disengage it from the print means. The area 20 may be constituted by a flange, a runner or a freely rotating roller.

It may be seen that the latch 9 delimits with the cover 3 an area 21 for storing printed tickets 5*a*–5*d* after the substrate 5 has been printed and cut. The tickets then pile up in this area and it is not necessary to remove them immediately. Moreover, this area 20 constitutes a means of protecting the ticket or tickets, preventing possible losses.

The latch 9 is equipped with a means 22 for detecting possible substrate 5 jams between the substrate cutter 13 and the ejection roller 11 and with a means 23 for reading the information printed on the substrate 5. This means 23, a CIS (contact image sensor) in this case, ensures the quality of the information printed on the substrate 5. These two means 22 and 23 are placed in this case on either side of the lower branch 15 of the latch 9.

The latch 9 therefore allows the cover (3) to be opened, locked and unlocked. It acts as a counter support to the ejection roller 11. It supports jam detection means and printed substrate selection means. Moreover, it allows the printed substrates to be stored. These various functions make it a multifunction latch or handle.

What is claimed is:

1. A machine (1) for printing a substrate (5) taken from a supply (50), including a frame (2), a cover (3) movable relative to the frame, said frame (2) receiving the supply, and means (4) for printing the substrate (5) including in particular a print roller (6) and a print head, a machine characterized in that it also includes a latch (9) articulated relative to the frame (2) allowing the cover to be unlocked relative to the frame wherein a printed substrate (5) ejection roller (11) is provided integral with the cover (3) wherein the ejection roller (11) is placed to push against a counter-support surface (20) of the latch (9) so as to drive the printed substrate.

2. A printing machine according to claim 1, wherein the latch (9) is placed in the vicinity of the printed substrate (5) output trajectory.

3. A printing machine according to claim 1, wherein the latch (9) is an approximately L-shaped handle whose lower branch (15) is placed so as to engage with the cover (3) and whose upper branch (14) is placed so as to be activated by a user.

4. A printing machine according to claim 3 wherein the lower branch (15) of the latch (9) is equipped with hooks (17) to engage with the cover (3).

5. A printing machine according to claim 1 wherein the ejection roller (11) is placed so as to be driven by a motor (12).

6. A printing machine according to claim 1 wherein the counter-support surface (20) of the latch (9) is constituted by a flange, a roller or rotating runner.

7. A printing machine according to claim 1 wherein the latch (9) with the cover (3) delimits a printed substrate reception housing.

8. A printing machine according to claim 1 wherein printed substrate (5) jam detection means (22) are provided integral with the latch (9).

9. A printing machine according to claim 1 wherein printed substrate (5) read means (23) are provided integral with the latch (9).

* * * * *